United States Patent [19]

Romanauskas

[11] Patent Number: 4,764,162

[45] Date of Patent: Aug. 16, 1988

[54] REMOVABLE DOOR SEAL ASSEMBLY FOR A CENTRIFUGE

[75] Inventor: William A. Romanauskas, Southbury, Conn.

[73] Assignee: E. I. Du Pont de Nemours and Company, Wilmington, Del.

[21] Appl. No.: 926,180

[22] Filed: Nov. 3, 1986

[51] Int. Cl.[4] ..... B04B 7/02

[52] U.S. Cl. ..... 494/38; 494/39; 494/61; 277/206 R

[58] Field of Search ..... 494/38, 39, 61; 277/12, 277/27, 206 R; 220/345

[56] References Cited

U.S. PATENT DOCUMENTS

| | | | |
|---|---|---|---|
| 2,681,166 | 6/1954 | Scofield | 220/345 X |
| 3,184,246 | 5/1965 | Kline | 277/206 R X |
| 3,347,453 | 10/1967 | Goergen | 494/39 X |
| 3,391,862 | 7/1968 | Jacobson et al. | 494/39 |
| 3,684,163 | 8/1972 | Hashimoto | 494/39 |
| 4,053,104 | 10/1977 | Penhasi et al. | 494/14 |
| 4,196,844 | 4/1980 | Jacobson | 494/39 |
| 4,221,325 | 9/1980 | Kubota | 494/38 X |
| 4,322,029 | 3/1982 | Gropper et al. | 494/10 |
| 4,666,424 | 5/1987 | Harlacker | 220/345 X |

*Primary Examiner*—John Petrakes
*Assistant Examiner*—Katherine Matecki

[57] ABSTRACT

A removable seal assembly for a centrifuge door includes a seal support plate slidably received in guide rails mounted to the undersurface of the door. The plate has a central opening lined with an annular seal support element. A flange secures the plate to the edge of the door. The support plate is slidably removable from the guide rails.

9 Claims, 3 Drawing Sheets

REMOVABLE DOOR SEAL ASSEMBLY FOR A CENTRIFUGE

BACKGROUND OF THE INVENTION

1. Field of the Invention

The present invention relates to a centrifuge instrument and, in particular, to a removable seal assembly for the centrifuge door.

2. Description of the Prior Art

A centrifuge instrument of the type having an rotor chamber is presently provided with a door member which is slidable between a first, retracted, and a second, closed, position. In the retracted position access is afforded to the interior of the chamber and the rotor member rotatably mounted therewithin. In the closed position, the door overlies the access opening of the rotor chamber to confine any missiles or projectiles which may be formed in the event of a rotor burst and to prevent the exit of the same from the rotor chamber.

In some of the relatively higher speed centrifuge instruments, i.e., those operable at rotation speeds of twenty-five thousand rpm or more, the rotor chambe is evacuable by means of suitable evacuation pump. In this event, a seal is disposed between the surface of the door presented to the interior of the chamber and the upper surface of the frame of the centrifuge whereby sealed integrity for the rotor chamber may be maintained.

The door is typically provided with rollers which are confined and guided in a suitable trackway mounted in the frame of the instrument. Suitable detent recesses are provided in the trackway to accommodate the roller and permit the door, when it reaches the closed position, to drop vertically into contact with the seal assembly whereby the sealing of the chamber may be effected.

Typically, the seal resides in a groove provided in the top plate of the centrifuge frame concentrically surrounding the opening of the chamber. This location subjects the groove end seal to spillage, condensation and dirt, etc., requiring frequent cleaning.

In addition the underside of the door mat comes into contact with the seal is not easily accessible for cleaning or inspection. As the constraints on centrifuge instruments becomes more focused toward the cleanliness aspect of centrifuge operation, the inability to easily provide a thorough cleaning to the door and the seal is perceived as a disadvantage.

Accordingly, in view of the foregoing, it is believed to be advantageous to provide a centrifuge seal assembly which is removably mounted with respect to the instrument whereby the cleaning of the seal may be efficiently and thoroughly handled.

SUMMARY OF THE INVENTION

In accordance with the present invention, a removable seal assembly is provided for the centrifuge door. The seal assembly includes a seal support plate having an opening configured substantially the same as the configuration of the access aperture of the top plate of the centrifuge instrument. A seal member having upper and lower lips is supported on the inner edge of the seal support plate. A pair of guide members each having a guide groove therein is mounted to one the underside of the door or the upper surface of the top plate of the instrument. The lips on the seal member respectively overlie the upper and lower surfaces of the support plate. The outside edge of the seal support plate is slidably received within the guide groove in each of the guide members. The support plate has a mounting flange whereby the plate may be secured to the same member to which the guide rails are mounted. When it is desired to clean the seal, the attachment mechanism is removed and the seal support plate is slidably removed from the grooves in the guides whereby the seal member may be thoroughly and efficiently cleaned.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
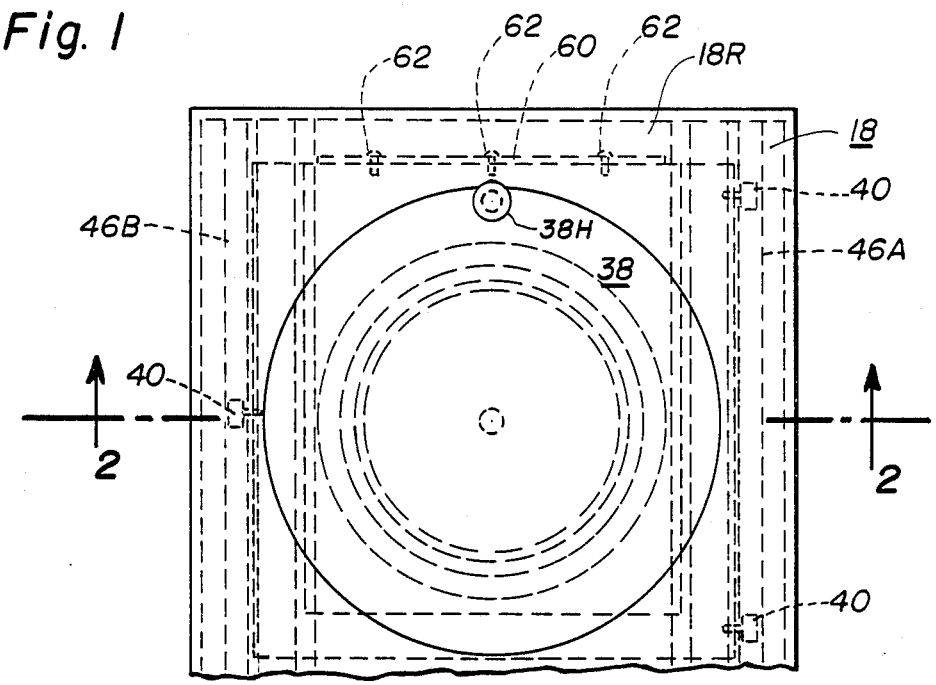
FIG. 1 is a plan view of a centrifuge instrument having a removable door seal assembly in accordance with the present invention.

Throughout the following detailed description, similar reference numerals refer to similar elements in all figures of the drawings.

Figure 2:
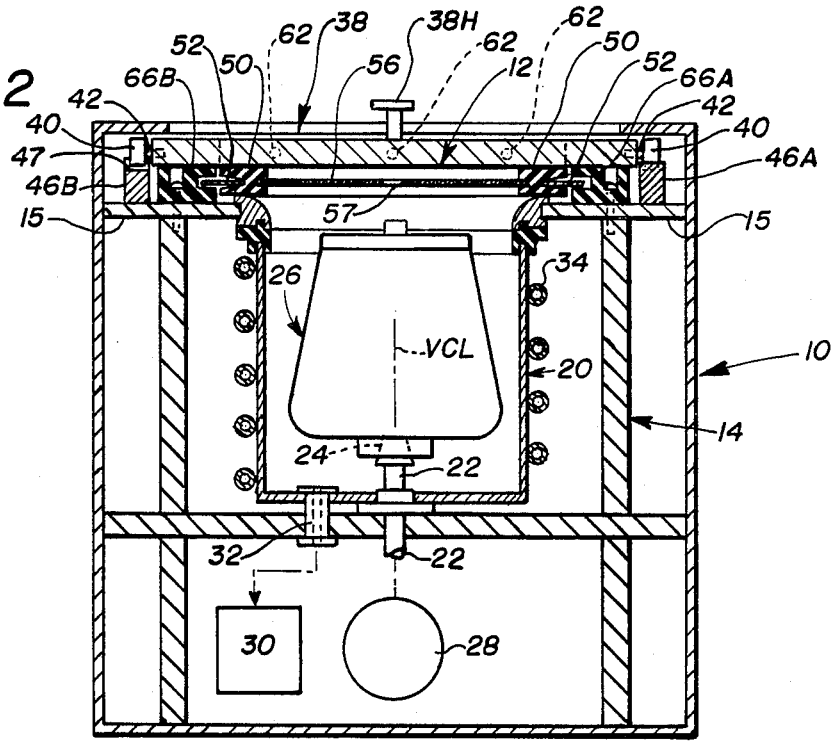
FIG. 2 is a view looking taken along section lines 2—2 of FIG. 1.

Shown in FIGS. 1 and 2 are, respectively a plan and a side sectional view of a centrifuge instrument generally indicated of reference character 10 having a removable door seal assembly 12 in accordance with the present invention.

The centrifuge 10 includes a structural framework 14 formed of relatively massive plate members including an upper, or top, plate 15 having an access opening 16 defined therein. An annular edging member 17 (FIGS. 4 and 5) is attached to the top plate 15 about the opening 16. A sheet metal or plastic skin 18 is supported by the framework 14 and surrounds the instrument 10. A portion 18R of the skin 18 is removable for a purpose to be described. Any convenient means of attaching the portion 18R of the skin 18 may be used.

Suitably mounted within the framework 14 of the centrifuge 10 and communicating with the access opening 16 is a rotor chamber, or bowl, 20. A drive shaft 22 projects into the interior of the rotor chamber 20. A gasket 21 (FIGS. 4 and 5) may be disposed between the upper edge of the bowl 20 and the edging 17. The drive shaft 22 has a mounting spud 24 on its upper end which accepts a rotor 26 thereon. The drive shaft 22 is mechanically linked to a source 28 of motive energy whereby rotation of the rotor 26 about the vertical central axis of rotation VCL may be effected. The bowl 20 may be evacuated by a suitable vacuum pump 30 communicating with the bowl 20 via a vacuum port 32. Refrigeration coils 34 are disposed on the outer surface of the bowl 20 to lower the ambient temperature therewithin.

Figure 3:
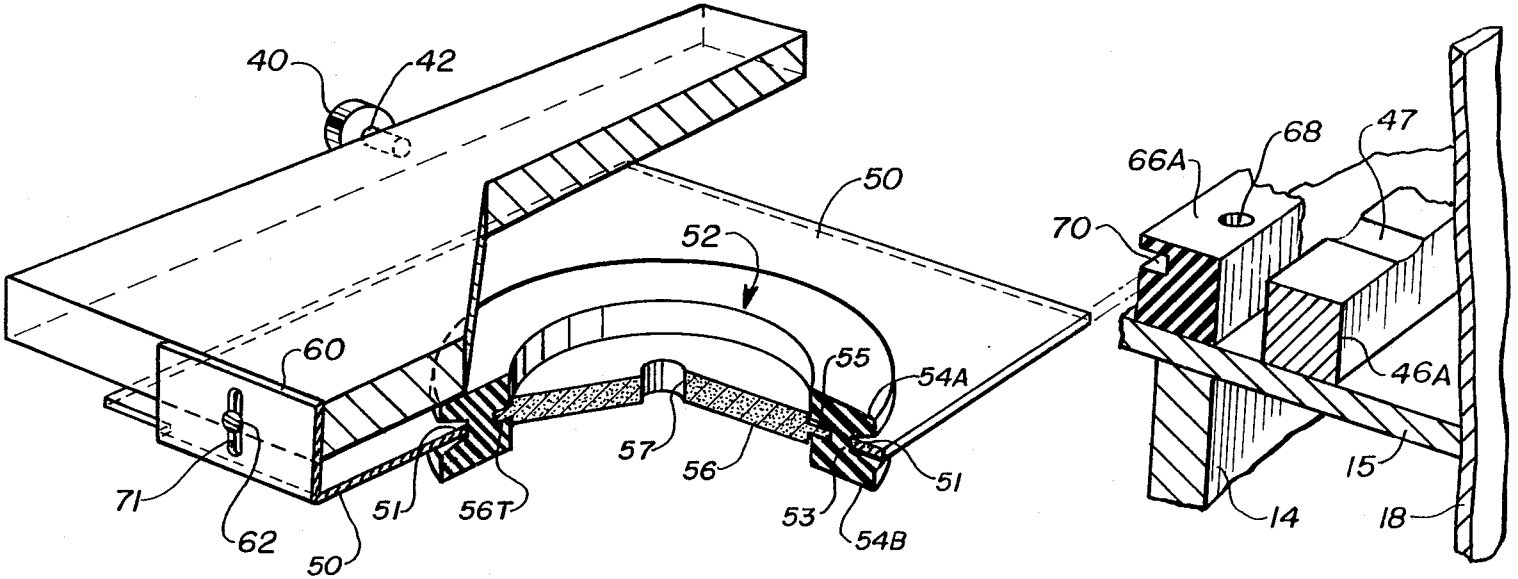
FIG. 3 is a perspective view of the centrifuge door seal assembly in accordance with the present invention with portions broken away for clarity.
Figure 4:
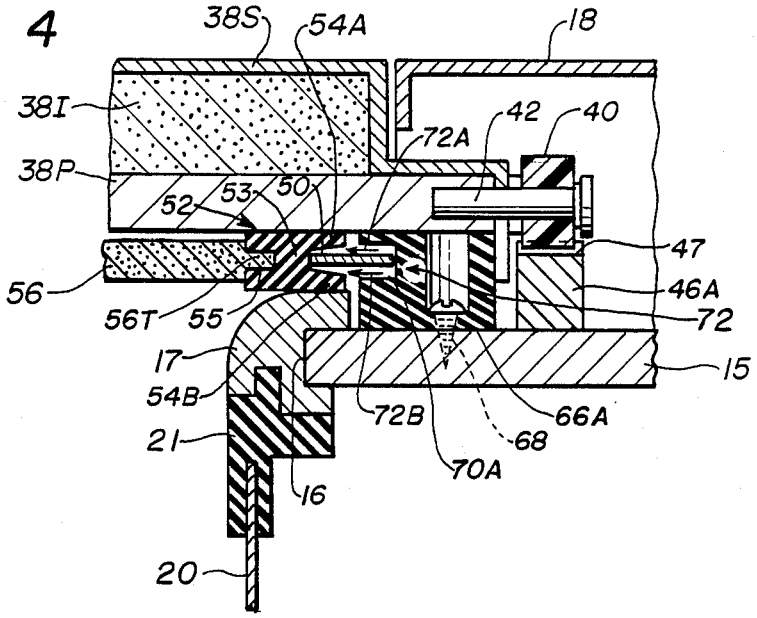
FIG. 4 is an enlarged side elevation view taken along sections lines 4—4 in FIG. 1.
Figure 5:
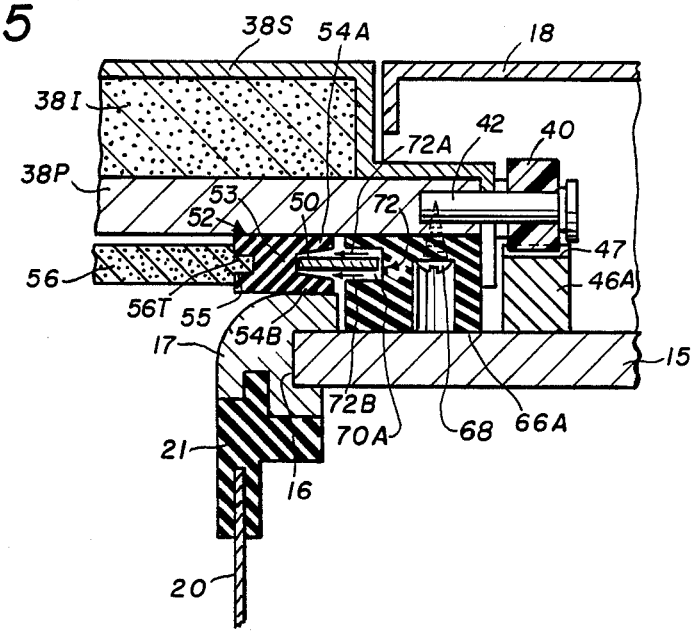
FIG. 5 is a view similar to FIG. 4 illustrating an alternate embodiment of the present invention.

The centrifuge 10 includes a door 38 with a handle 38H that is slidably mounted with respect to the framework 14 and particularly to the top plate 16 of the centrifuge from a first, open, position to a second, closed, position. In the open position the access opening 16 in the top plate 15 is uncovered and access to the interior of the bowl 20 and to the rotor 26 disposed therein may be had. However, when the door 38 is in the closed position the door 38 overlies and completely blocks access to the interior of the bowl 20. The door is fabricated of a steel plate 38P covered by an insulating layer 38I and a sheet metal or plastic skin 38S (FIGS. 3, 4 and 5).

The door 38 is provided in the typical instance with an array (typically three in number) of rollers 40 which are supported from the side edges of the door 38 by pins 42. The rollers 40 are constrained to move on a pair of tracks 46A, 46B disposed in parallel on the top plate 15 on opposite sides of the opening 16 therein. The tracks 46 are provided with a number of detent recesses 47 (FIGS. 4, 5) corresponding in number to the number of rollers such that, when closed, the rollers 40 seat firmly in the detents.

The removable door seal assembly 12 includes a seal support plate 50 having a central opening 51 conforming substantially in shape to the shape of the access opening 16 in the top plate 15. The support plate 50 is provided with an annular seal member 52 mounted about the periphery of the opening 51 therein. The seal member 52 includes an annular main body portion 53 having two radially outwardly projecting lips 54A, 54B projecting therefrom. The lips 54A, 54B are arranged to overlie the upper and lower surfaces respectively, of the support plate 50. The inner surface of the main body portion 53 of the seal member 52 has a groove 55 formed therein. An insulating insert 56 having a peripheral tongue 56T thereon is received in the groove 55. The insert 56 itself has a central opening 57 therein. The opening 57 permits vacuum to be drawn in the space above and below the seal 52 and insert 56. One edge of the support plate 50 is turned to define a mounting flange 60 that extends substantially perpendicularly to the plane of the support plate 50. The plate 50 is secured to either the edge of the door or to the top plate 16 by shoulder bolts 62.

In accordance with the present invention a pair of plate guides, such as rails 66A, 66B, are suitably mounted to one or the other of the top plate 15 (FIG. 4) or the undersurface of the door 38 (FIG. 5) by bolts 68. Preferably the guide rails 66 are mounted to the undersurface of the door 38. The guide rails 66 are formed of a heat insulating material and have a groove 70A, 70B extending lengthwise there along. The walls of the grooves 70 respectively define upper and lower guide surfaces for the edges of the seal support plate 50 as the same is slidably received therein.

The seal support plate 50 is slidably introduced at its edges into the groove 70 defined by each of the guide rails 66 and advanced along the guide rails 66 until the mounting flange 60 abuts against the end of the door 38 whereby the seal support plate 50 may be affixed to the door 38 in such a manner as to allow limited vertical movement for a purpose to be described. Alternatively, as seen in FIG. 4, the guide rails 66 may be mounted to the top plate 15 in which case the mounting flange 60 of the seal support plate 50 is suitably affixed to the top plate 15 at a convenient location to secure the plate 50 with respect to the top plate 15. Slots 71 permit slight vertical movement of the plate 50.

When the door 38 reaches the closed position the annular seal member 52 is concentrically disposed about the access aperture 16 in the top plate 15. During the movement of the door 38 from the open to the closed positions the edges of the seal support plate 50 are supported by the lower guide walls of the grooves 70 in the guide rails 66. When the door 38 reaches the closed position and the rollers 40 thereon drop a short distance vertically into the detents resilient lips 54A, 54B of the seal 52 are compressed between the undersurface of the door 38 and the upper surface of the edging 17 on the top plate 15. This causes the support plate 50 to be lifted away from the lower wall of the groove 70, as seen in FIGS. 4 and 5 at reference character 72. When the bowl 16 is evacuated ambient air acts upwardly and downwardly, as shown by the arrows 72A, 72B against the lips 54A, 54B urging them more tightly into contact with the adjacent surface of the door 38 and the top plate 15, respectively, thus enhancing the seal.

To clean the seal 52 and the insert 56 the portion 18R of the skin 18 of the instrument is lifted away, the attachment bolts 62 are removed and the plate 50 is slidably removed from the guide rails 66. The plate 50 and the seal 52 may at that time be removed to a suitable location and washed.

In view of the foregoing it may be appreciated that numerous modifications may be imparted to the above described invention. However, these and other modifications are to be construed as lying within the scope of the present invention as defined in the appended claims.

What is claimed is:

1. In a centrifuge instrument of the type having a frame with a top plate having an access opening therein, a door movable with respect to the top plate from a first, open, position to a second, closed, position, with the door in the closed position covering the access opening in the top plate, wherein the improvement comprises:

a pair of guides each having a groove therein, the groove having an upper and a lower guide surface thereon;

a seal support receivable within the groove on each of the guides; and a seal member mounted to the support, the seal support and the seal thereon being removable from the guides as a unit.

2. The centrifuge of claim 1 wherein the door has an undersurface thereon and wherein the guides are mounted to the undersurface of the door and wherein the seal support further comprises a flange on the edge thereof, the flange being bent to extend substantially perpendicularly to the plane of the seal support, the flange being removably attached to the door along an edge thereof.

3. The centrifuge of claim 2 wherein the seal support has an upper and lower surface and wherein the seal has an upper and a lower lip thereon, the lips respectively extending in overlying relationship with respect to the upper and the lower surface of the seal support.

4. The centrifuge of claim 3 wherein the seal is an annular member and further comprising an insert disposed in the annular seal member, the insert having an opening therein.

5. The centrifuge of claim 1 wherein the top plate has a surface thereon and wherein the guides are mounted to the surface of the top plate and wherein the seal support further comprises a flange on the edge thereof, the flange being bent to extend substantailly perpendicularly to the plane of the seal support, the flange being removably attached to the top plate along an edge thereof.

6. The centrifuge of claim 5 wherein the seal support has an upper and lower surface and wherein the seal has an upper and a lower lip thereon, the lips respectively extending in overlying relationship with respect to the upper and the lower surface of the seal support.

7. The centrifuge of claim 6 wherein the seal is an annular member and further comprising an insert disposed in the annular seal member, the insert having an opening therein.

8. The centrifuge of claim 1 wherein the seal support has an upper and lower surface and wherein the seal has an upper and a lower lip thereon, the lips respectively extending in overlying relationship with respect to the upper and the lower surface of the seal support.

9. The centrifuge of claim 8 wherein the seal is an annular member and further comprising an insert disposed in the annular seal member, the insert having an opening therein.

* * * * *